US007057589B2

(12) United States Patent
Shin et al.

(10) Patent No.: US 7,057,589 B2
(45) Date of Patent: Jun. 6, 2006

(54) DISPLAY AND A DRIVING METHOD THEREOF

(75) Inventors: Dong-Yong Shin, Seoul (KR); Oh-Kyong Kwon, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 349 days.

(21) Appl. No.: 10/370,882

(22) Filed: Feb. 20, 2003

(65) Prior Publication Data

US 2003/0179164 A1 Sep. 25, 2003

(30) Foreign Application Priority Data

Mar. 21, 2002 (KR) ..... 2002-15437

(51) Int. Cl.
*G09G 3/32* (2006.01)

(52) U.S. Cl. ..... 345/82; 345/76; 345/204; 315/169.3

(58) Field of Classification Search ..... 345/76–82, 345/87–103, 208–210, 204–205; 315/169.1, 315/169.3

See application file for complete search history.

(56) References Cited

U.S. PATENT DOCUMENTS

| | | | | |
|---|---|---|---|---|
| 5,426,447 | A | 6/1995 | Lee | |
| 5,510,807 | A | 4/1996 | Lee et al. | |
| 5,686,936 | A * | 11/1997 | Maekawa et al. | 345/100 |
| 5,708,454 | A | 1/1998 | Katoh et al. | |
| 6,229,506 | B1 | 5/2001 | Dawson et al. | |
| 6,229,508 | B1 * | 5/2001 | Kane | 345/82 |
| 6,362,798 | B1 | 3/2002 | Kimura et al. | |
| 6,369,786 | B1 * | 4/2002 | Suzuki | 345/77 |
| 6,580,408 | B1 | 6/2003 | Bae et al. | |
| 6,650,060 | B1 | 11/2003 | Okuda | |
| 6,731,266 | B1 | 5/2004 | Jung | |
| 6,760,005 | B1 * | 7/2004 | Koyama et al. | 345/98 |
| 6,809,482 | B1 | 10/2004 | Koyama | |
| 2002/0047581 | A1 | 4/2002 | Koyama | |
| 2002/0118150 | A1 | 8/2002 | Kwon | |
| 2004/0041769 | A1 | 3/2004 | Yamashita et al. | |

FOREIGN PATENT DOCUMENTS

| | | | |
|---|---|---|---|
| EP | 0 905 673 | A1 | 3/1999 |
| EP | 1 220 191 | A2 | 7/2002 |
| EP | 1 220 191 | A3 | 9/2003 |
| JP | 02-082295 | * | 3/1990 |

* cited by examiner

*Primary Examiner*—Lun-yi Lao
(74) *Attorney, Agent, or Firm*—Christie, Parker and Hale, LLP

(57) ABSTRACT

In a display, capacitors are charged with first precharge voltages at the time of applying selection signals to previous scan lines. A data driver divides a plurality of data lines into a plurality of groups each of which consists of at least one data line and applies corresponding data voltages to the data lines of respective groups sequentially. The display further includes a precharge means, and such precharge means applies second precharge voltages to data lines of at least one group before selection signals for selecting scan line are applied to the scan line connected to the pixel circuits and stops application of the second precharge voltages before corresponding data voltages are applied to the respective groups. In this way, it is possible to solve the problem of poor images due to charge redistribution of the capacitors caused by previous data voltages stored in parasitic capacitors.

38 Claims, 13 Drawing Sheets

DISPLAY AND A DRIVING METHOD THEREOF

CROSS-REFERENCE TO RELATED APPLICATIONS

This application claims priority to and the benefit of Korean Application No. 2002-0015437, filed on Mar. 21, 2002 in the Korean Intellectual Property Office, the entire disclosure of which is incorporated herein by reference.

BACKGROUND OF THE INVENTION (a) Field of the Invention

The present invention relates to a display and a driving method thereof, and more particularly to an organic electroluminescence (hereinafter, "EL") display of an active matrix driving method.

(b) Description of the Related Art

In general, an organic EL display is a display that emits light by electrical excitation of fluorescent organic compound and displays image by driving each of M×N organic luminescent cells with voltage or current.

This organic cell has a structure of an anode (ITO), an organic thin film and, a cathode layer (metal). The organic thin film is formed as a multi-layered structure including an emission layer ("EML"), an electron transport layer ("ETL"), and a hole transport layer ("HTL") so as to increase luminescence efficiency by balancing electron and hole concentrations. In addition, it can include an electron injection layer ("EIL") and a hole injection layer ("HIL") separately.

Organic EL displays that use organic luminescent cells like the above are configured as passive matrix or active matrix that includes thin film transistors (TFTs). In the passive matrix configuration, organic luminescent cells are formed between anodes and cathodes lines that cross each other and driven by driving those lines. While in the active matrix configuration, each organic luminescent cell is connected to a TFT usually through an ITO electrode and driven by controlling the gate voltage of the corresponding TFT.

FIG. 1 is a circuit diagram of a conventional pixel for driving the organic EL display using TFTs, and it is a representative of M×N pixels. Referring to FIG. 1, driving transistor Mb is connected to organic EL device OLED to supply current for emitting light. The amount of current through driving transistor Mb is controlled by data voltage applied through switching transistor Ma. In this case, capacitor C1 for maintaining the applied voltage during a certain period is connected between source and gate of transistor Mb. Scan line $X_M$ is connected to the gate of transistor Ma, and data line $Y_N$ is connected to the source thereof.

Operation of the pixel is as follows. When switching transistor Ma is turned on by the selection signal applied to the gate thereof, a data voltage is applied to node A, the gate of the driving transistor through the data line. Then, a current corresponding to the data voltage applied to the gate thereof flows into the organic EL device OLED to emit light.

In this case, current $I_{OLED}$ flowing through organic EL device OLED is referred to as Equation 1.

$$I_{OLED} = \frac{\beta}{2}(V_{GS} - V_{TH})^2 = \frac{\beta}{2}(V_{DD} - V_{DATA} - |V_{TH}|)^2 \quad (1)$$

wherein, $I_{OLED}$ is a current flowing through organic EL device OLED, $V_{GS}$ is the gate-to-source voltage of transistor Mb, $V_{TH}$ is a threshold voltage of transistor Mb, $V_{DATA}$ is a data voltage and β is a constant.

As expressed in Equation 1, according to the pixel circuit of FIG. 1, the current corresponding to the applied data voltage is supplied to organic EL device OLED, and organic EL device OLED emits light in correspondence to the supplied current. Herein, the applied data voltage has many levels to express corresponding gray levels.

However, in the conventional pixel as described above, there is a problem in that high gray scale is difficult to obtain due to variation of the threshold voltage of TFTs generated by manufacture process. For example, when driving transistor Mb is supplied with data voltage in the range of 3 volts, two data voltages representing adjacent gray levels must be apart from each other by approximately 12 mV (=3V/256) so as to implement 8-bit (256) gray scale. If the threshold voltage varies in 100 mV range, which is usually the case, it is difficult to discriminate one data voltage from another and, as a result, gray scale is reduced.

SUMMARY OF THE INVENTION

In accordance with the present invention precharge voltages are applied to data lines to display high gray scale by compensating for variation of threshold voltage and to remove poor images due to operating characteristics of thin film transistors of pixel circuits. According to first to third aspects of the present invention, an organic EL display is provided, which includes: a plurality of data lines transmitting data voltages; a plurality of scan lines transmitting selection signals; a plurality of pixel circuits; and a data driver. The pixel circuits are provided in pixel areas defined by two adjacent data lines and two adjacent scan lines and include first and second switching elements, first thin film transistors, and capacitors. The first switching elements respond to the selection signals applied to the scan lines to transmit the data voltages applied to the data lines, and the first thin film transistors supply currents to organic electroluminescence devices in correspondence to the data voltages inputted to gates thereof through the first switching elements. The capacitors maintain the data voltages during a certain period, and the second switching elements apply first precharge voltage to the capacitors in response to control signals while the selection signals are applied to previous scan lines.

In this case, it is preferable that the control signals are separate reset signals or selection signals applied to previous scan lines.

According to the first aspect of the present invention, the data driver divides a plurality of data lines into a plurality of groups to apply data voltage corresponding to the respective groups, and the organic EL display preferably further includes a demultiplexer. The demultiplexer applies data voltages sequentially applied from the data driver to the corresponding data lines and applies second precharge voltages to data lines of at least one group before selection signals for selecting scan lines are applied to the scan lines connected to the pixel circuits.

According to the second aspect, the data driver applies the data voltages to respective data lines sequentially, and the organic EL display preferably further includes a precharge means, which applies second precharge voltages to the data lines simultaneously before selection signals for selecting scan lines are applied to the scan lines connected to the pixel circuits.

According to the third aspect, the data driver applies the data voltages to respective data lines, and the organic EL display preferably further includes a precharge means. The precharge means simultaneously applies second precharge voltages to all data lines before selection signals for selecting scan lines are applied to the scan lines connected to the pixel circuits and sequentially stops the application of the second precharge voltages before the data voltages are applied to the respective data lines sequentially.

In the organic EL display according to the first to the third aspects of the present invention, the pixel circuits may further include second thin film transistors of which the gates are connected to the gates of the first thin film transistors and that are diode-connected between the first and the second switching elements. In this case, the second precharge voltage preferably has a value equal to the first precharge voltage or a value further from the data voltage than that. In addition, the second precharge voltage preferably has a constant value.

According to the fourth aspect, a method of driving such an organic EL display is provided. First, the capacitor of the pixel circuit connected to i-th scan line is precharged with the first precharge voltage while selection signal is applied to (i−1)th scan line. And, the data lines are applied with second precharge voltages before selection signal is applied to the i-th scan line. Next, data voltages are sequentially applied to corresponding groups of data lines which consist of at least one data line and applications of the second precharge voltages to each group of data lines are stopped before the data voltages are applied to those lines.

According to a fifth aspect, a display is provided, which includes a plurality of data lines, a plurality of scan lines, a plurality of pixel circuits, a data driver, and a scan driver. The pixel circuits are provided in pixel areas defined by two adjacent data lines and two adjacent scan lines. Each of the pixel circuits includes a first switching element responding to selection signal applied to the scan line to transmit data voltage applied to the data line, a capacitor for maintaining the data voltage during a certain period, and a second switching element applying a first precharge voltage to the capacitor in response to control signal while selection signal is applied to the previous scan line.

In this case, the data driver divides a plurality of data lines into a plurality of groups each of which consists of at least one data line and applies corresponding data voltages to the respective groups sequentially. Second precharge voltages are applied to data lines of at least one group before selection signals for selecting scan lines are applied to the scan lines connected to the pixel circuits, and the application of second precharge voltages is stopped when corresponding data voltages are applied to the respective groups.

Control signals are preferably selection signals applied to previous scan lines or separate reset signals.

DETAILED DESCRIPTION

Figure 1:
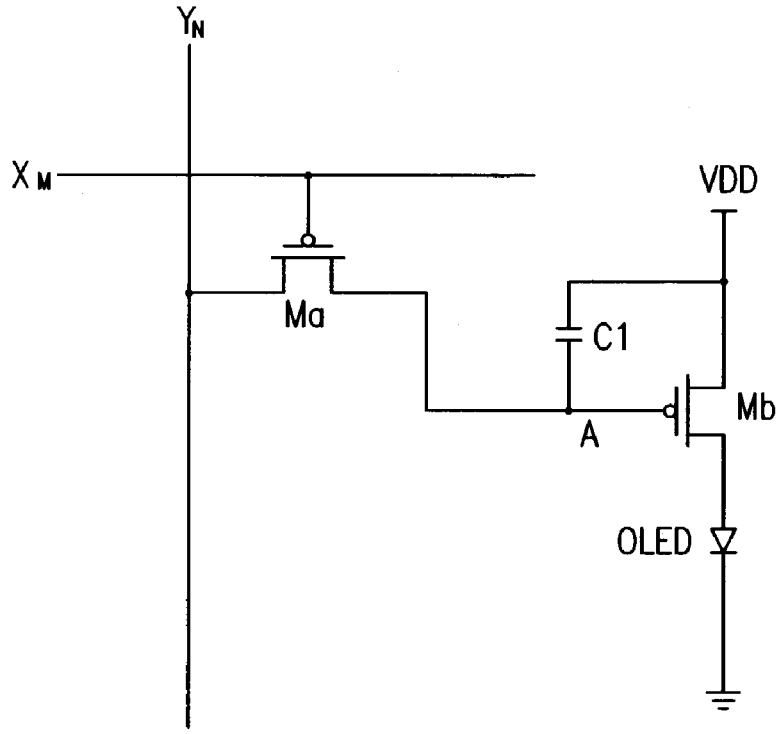
FIG.1(Prior Art)
FIG. 1 shows a circuit diagram of a pixel of an organic EL display according to the prior art.

In the description set forth herein similar parts are denoted by the same reference numerals. When a part is connected to another part, the part is not only directly connected to another part but also electrically connected (coupled) to another part with another device intervening in them.

First, referring to FIG. 2, FIG. 3A, and FIG. 3B, an organic EL display and a driving method thereof according to a first embodiment of the present invention will be described.

Figure 2:
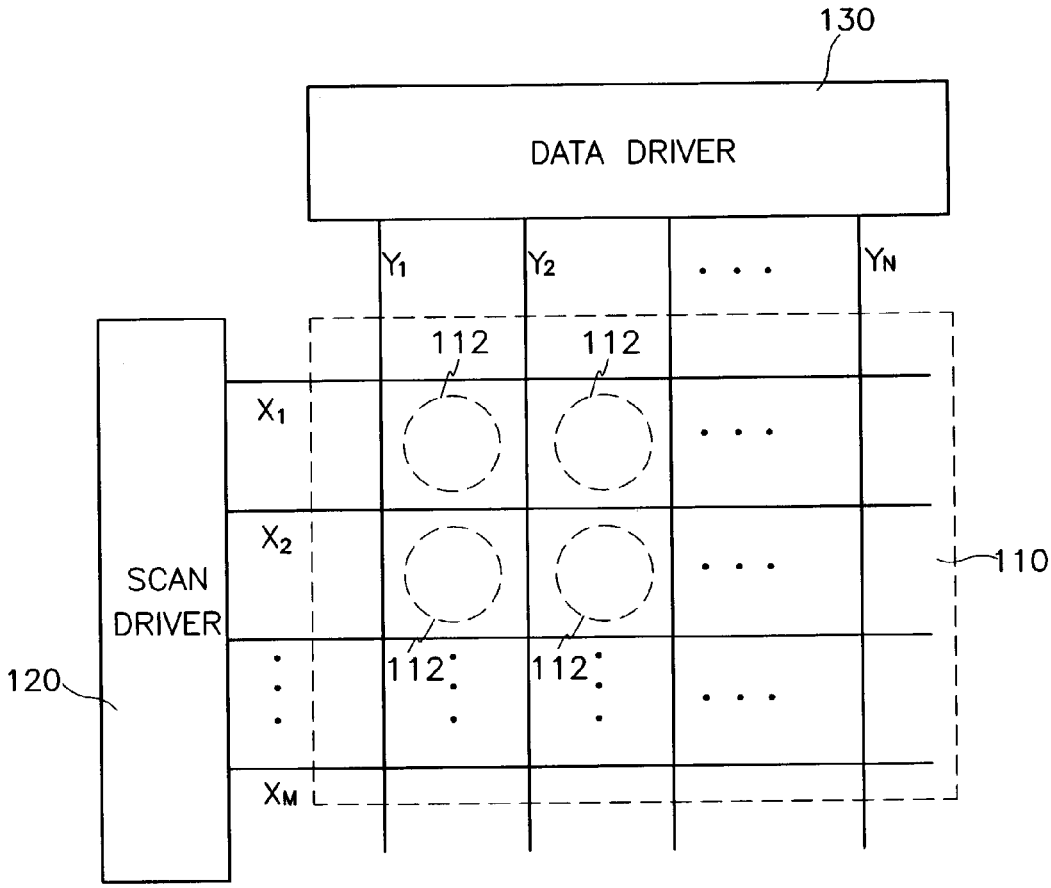
FIG. 2 and FIG. 4 show organic EL displays according to first and second embodiments of the present invention, respectively.
Figure 3A:
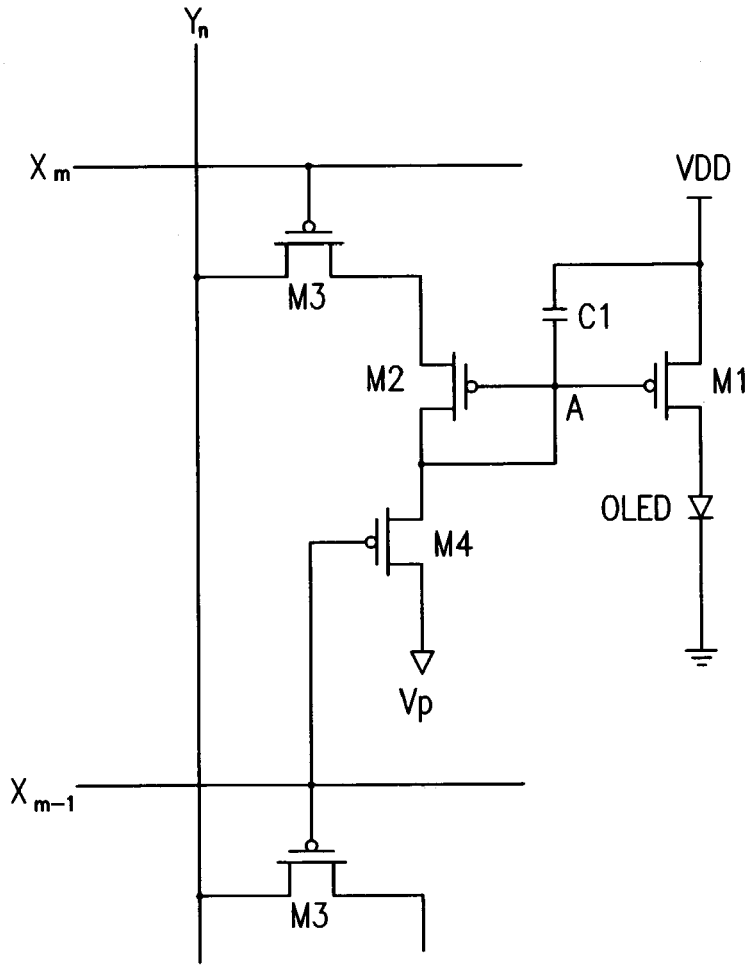
FIG. 3A and FIG. 3B show a representative pixel of the first embodiment and a modified example thereof according to the present invention, respectively.
Figure 3B:
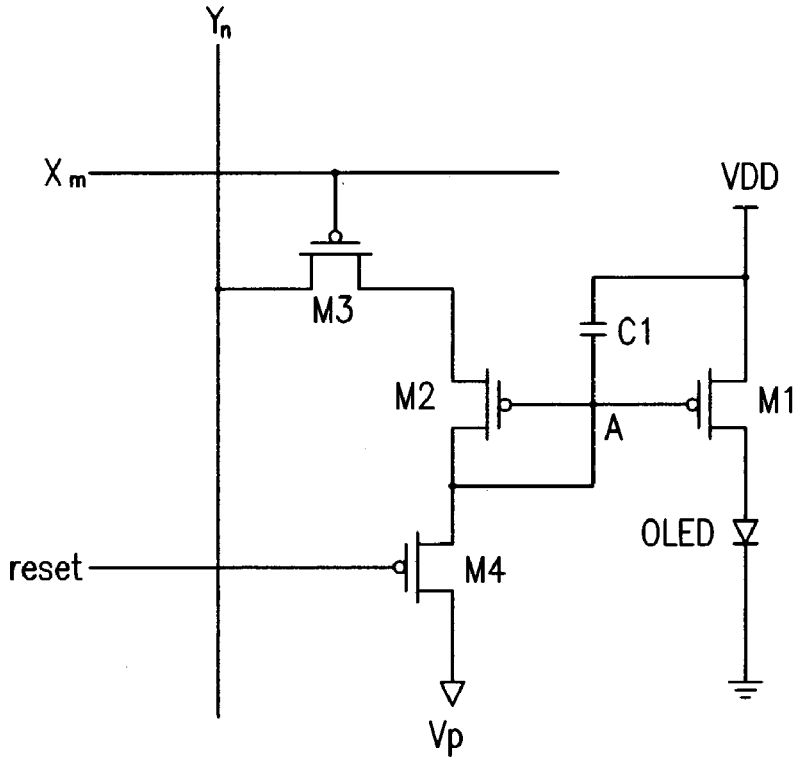

FIG. 2 shows an organic EL display according to a first embodiment of the present invention, and FIG. 3A and FIG. 3B show a representative pixel of the first embodiment and a modified example thereof according to the present invention, respectively.

As shown in FIG. 2, the organic EL display according to the first embodiment of the present invention includes organic EL display panel 110, scan driver 120, and data driver 130.

Organic EL display panel 110 includes a plurality of data lines $Y_1$ to $Y_N$ transmitting data voltages, a plurality of scan lines $X_1$ to $X_M$ transmitting selection signals, and a plurality of pixel circuits 112. Pixel circuits 112 are provided in pixel areas defined by two adjacent data lines and two adjacent scan lines. Scan driver 120 applies the selection signals to scan lines $X_1$ to $X_M$, and data driver 130 applies the data voltages representing image signals to data lines $Y_1$ to $Y_N$.

As shown in FIG. 3A, pixel circuit 112 according to the first embodiment of the present invention includes organic EL device OLED; transistors M1, M2, M3, and M4; and capacitor C1.

Transistor M3 has a gate connected to scan line $X_m$, a source connected to the data line and a drain connected to a source of transistor M2, to transmit the data voltage to transistor M2 in response to the selection signal applied to scan line $X_m$.

The gate and the drain of transistor M2 are connected with each other so as to work as a diode (diode-connected) to transmit the data voltage from transistor M3 to transistor M1.

Transistor M1 has a source connected to power voltage VDD, a drain connected to organic EL device OLED, and a gate connected to the drain of transistor M2, and supplies a current corresponding to the data voltage from transistor M2 to organic EL device OLED. Organic EL device OLED emits light corresponding to the supplied current.

Capacitor C1 is connected between power voltage VDD and the gate of transistor M1 to maintain the data voltage and precharge voltage Vp applied to the gate of transistor M1 during a specific period.

Transistor M4 has a gate connected to previous scan line $X_{m-1}$, a source connected to the drain of transistor M2, and a drain the precharge voltage Vp is applied to, and initializes the gate of transistor M1 to precharge voltage Vp in response to the selection signal applied to previous scan line $X_{m-1}$.

In this case, precharge voltage Vp is preferably set to a somewhat smaller value than that of a voltage of node A corresponding to the highest gray level (i.e., a voltage corresponding to the minimum voltage applied to the data line).

Once transistor M3 is turned on by the selection signal applied to scan line $X_m$, the data voltage applied to the data line is transmitted to the gate (node A) of driving transistor M1 through transistor M2. Then, a current corresponding to the data voltage applied to the gate thereof flows through organic EL device OLED, passing through transistor M1, to emit light.

In this case, the current flowing through organic EL device OLED according to the first embodiment of the present invention is as following Equation 2.

$$I_{OLED} = \frac{\beta}{2}(V_{GS} - V_{TH1})^2 = \frac{\beta}{2}(V_{DD} - (V_{DATA} - |V_{TH2}|) - |V_{TH1}|)^2 \quad (2)$$

Wherein, $I_{OLED}$ is a current flowing through organic EL device OLED, $V_{GS}$ is a gate-to-source voltage of transistor M1, $V_{TH1}$ is a threshold voltage of transistor M1, $V_{TH2}$ is a threshold voltage of transistor M2, and β is a constant.

In this case, if the threshold voltages of transistor M1 and transistor M2 are equal, i.e., $V_{TH1}=V_{TH2}$, Equation 2 can be expressed as the following Equation 3. In practice, according to the first embodiment, since the two transistors M1 and M2 are adjacent to each other to be influenced almost equally by the process, difference between the threshold voltages of the two transistors M1 and M2 is negligible, and thereby the threshold voltages become equal.

$$I_{OLED} = \frac{\beta}{2}(V_{DD} - V_{DATA})^2 \quad (3)$$

Therefore, according to the first embodiment of the present invention, as seen in Equation 3, current $I_{OLED}$ corresponding to the data voltage applied to the data line flows in organic EL device OLED regardless of the threshold voltage of current driving transistor M1. That is, since transistor M2 compensates for the variation of the threshold voltage of current driving transistor M1, the current flowing through organic EL device OLED can be controlled minutely to provide an organic EL display of high gray scale.

Although transistors M1, M2, M3, and M4 of pixel circuit 112 have been described with PMOS transistors in the first embodiment of the present invention, the present invention is not limited to this but may use NMOS transistors or the combination of PMOS and NMOS transistors. Since modification of pixel circuits for these cases can be easily configured by those who have common knowledge in the fields related to this invention, no detailed description will be included herein.

In addition, in the first embodiment of the present invention, transistor M4 is driven by the selection signal of previous scan line $X_{m-1}$ in order to initialize the gate of transistor M1 of pixel circuit 112 to precharge voltage Vp. However, as shown in FIG. 3B, transistor M4 may be driven by applying a separate reset signal to the gate of transistor M4 without applying the selection signal of previous scan line $X_{m-1}$ to the gate thereof.

Herein, when the data voltages are applied to the data lines, the data voltages may be applied to all data lines $Y_1$ to $Y_N$ not at once, but sequentially. In the case wherein the data voltages are applied sequentially, when a data voltage is applied to data line $Y_1$ with scan line $X_m$ selected, in data line $Y_2$, the data voltage applied at the time of selecting previous scan line $X_{m-1}$ is stored in a parasitic capacitor, and precharge voltage Vp is stored in capacitor C1 of pixel circuit 112.

In this case, if diode element M2 is turned on by difference between the voltage of the parasitic capacitor and the voltage of capacitor C1, the charges are redistributed between the parasitic capacitor and capacitor C1 to change the voltage of capacitor C1. As a result, transistor M2 may not be turned on by difference between the changed voltage of capacitor C1 and the data voltage applied to data line $Y_2$ later, and in this case, a desired voltage is not applied to capacitor C1 and desired images cannot be obtained.

To solve the above problem, precharge voltage Vpre is applied to the data line to which the data voltage is not applied to charge the data line with precharge voltage Vpre, and thereby, transistor M2 cannot be turned on by the difference between the voltage of capacitor C1 and precharge voltage Vpre. Herein, precharge voltage Vpre is equal to precharge voltage Vp—threshold voltage $V_{TH2}$' or further from the data voltage than that, so that transistor M2 is not turned on. The threshold voltage $V_{TH2}$ is negative in case transistor M2 is a PMOS transistor, and threshold voltage $V_{TH2}$ is positive in case transistor M2 is an NMOS transistor.

Now, a method of driving an organic EL display by applying such a precharge voltage Vpre will be described.

First, referring to FIG. 4 to FIG. 6, an organic EL display and a driving method thereof according to a second embodiment of the present invention will be described.

Figure 4:
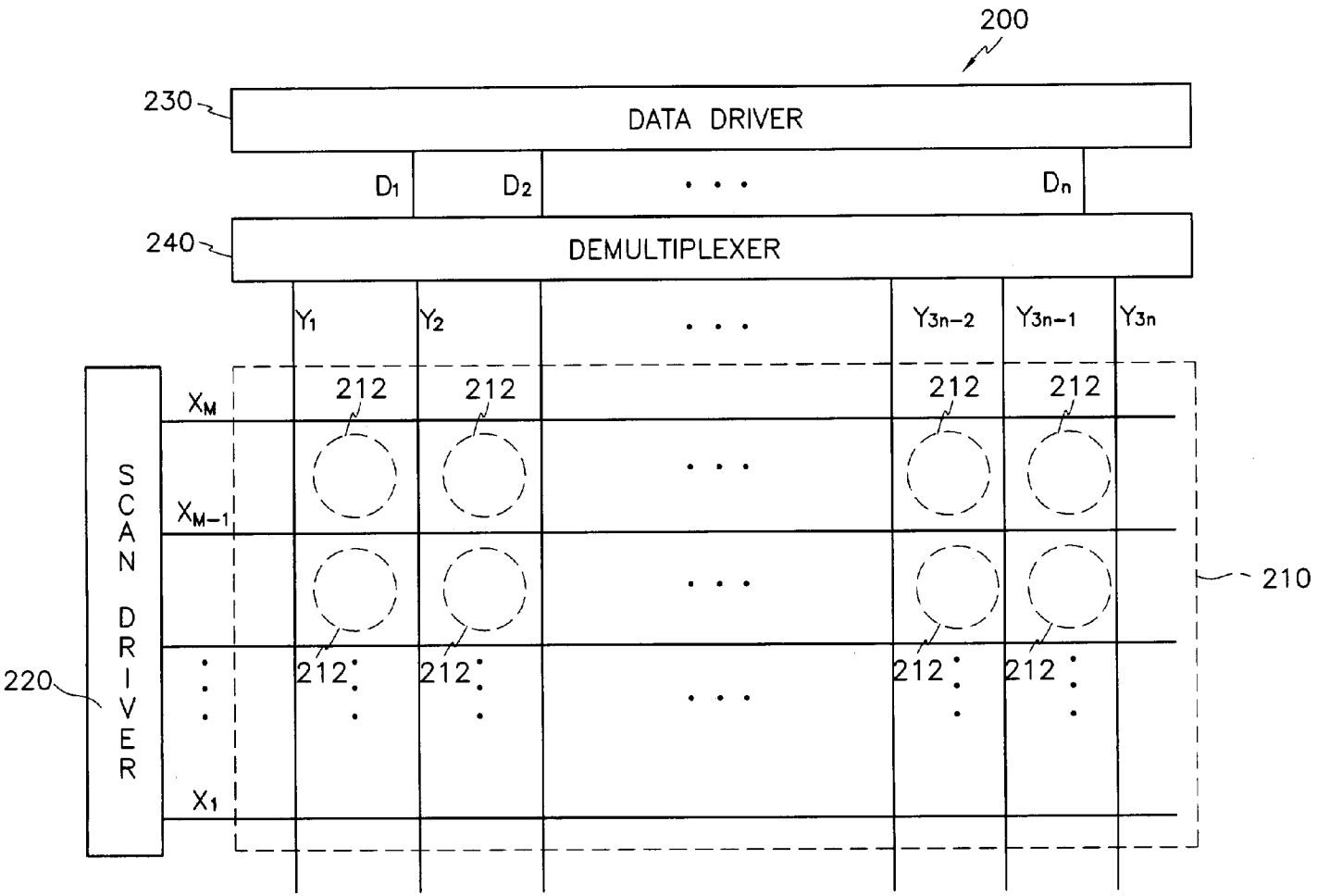
Figure 5:
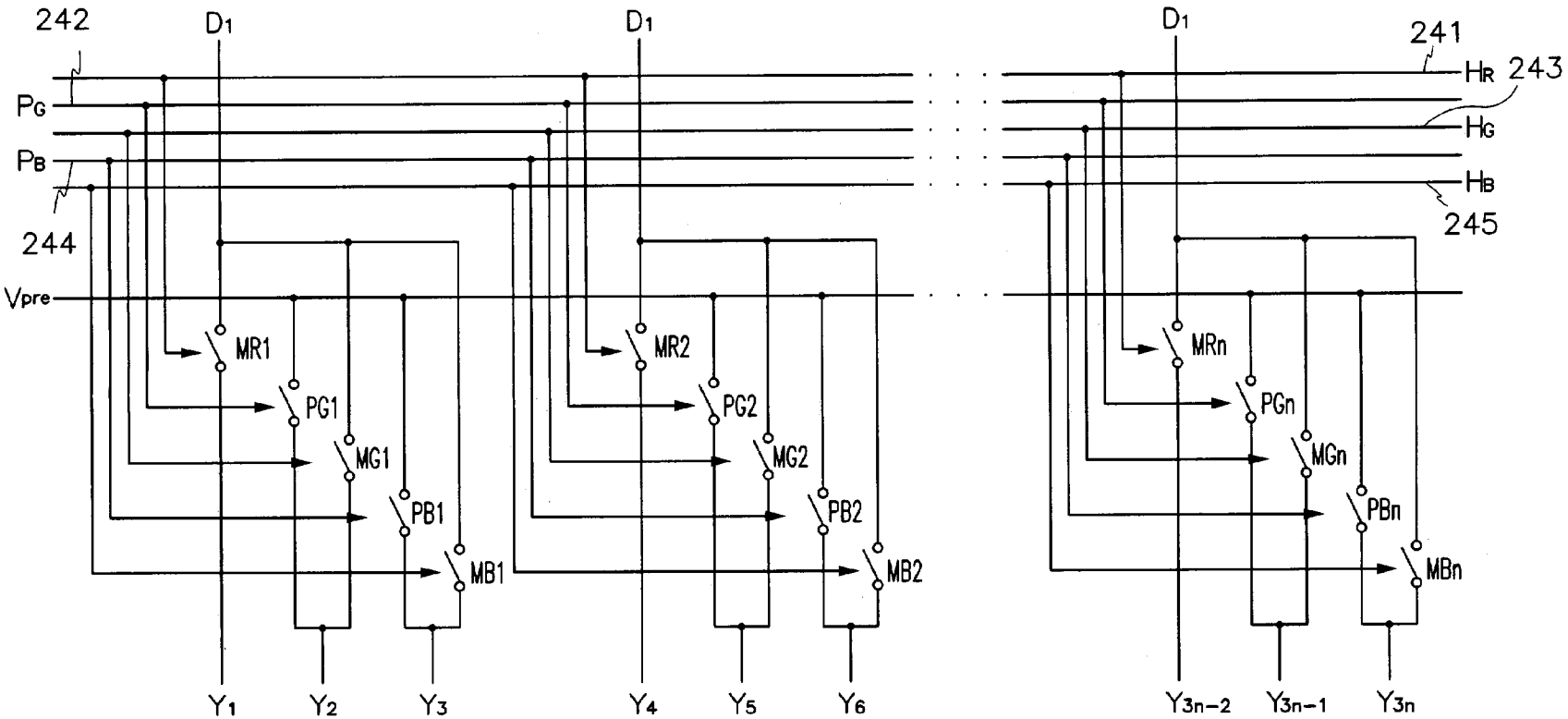
FIG. 5 shows a demultiplexer of the organic EL display according to the second embodiment of the present invention.

FIG. 4 shows an organic EL display according to a second embodiment of the present invention, and FIG. 5 shows a demultiplexer of the organic EL display according to the second embodiment of the present invention. FIG. 6 shows a timing diagram of the organic EL display according to the second embodiment of the present invention.

As shown in FIG. 4, organic EL display 200 according to the second embodiment of the present invention includes organic EL display panel 210, scan driver 220, data driver 230 and demultiplexer 240.

The organic EL display according to the second embodiment of the present invention has the same configuration as that of the first embodiment except for data driver 230 and demultiplexer 240. Pixel circuit 212 of organic EL display panel 210 includes pixel circuit 112 according to the first embodiment of the present invention and all the pixel circuits capable of being modified in the first embodiment of the present invention.

Data driver 230 outputs the data voltages to demultiplexer 240 per R (red), G (green), and B (blue) sequentially under the control of a controller (not shown). When the number of data lines $Y_1, Y_2, Y_3, Y_4, Y_5, Y_6, \ldots, Y_{3n-2}, Y_{3n-1}$, and $Y_{3n}$ is 3n, i.e., data lines $Y_1, Y_4, \ldots, Y_{3n-2}$ transmitting the R data voltages, data lines $Y_2, Y_5, \ldots, Y_{3n-1}$ transmitting the G data voltages, and data line $Y_3, Y_6, \ldots, Y_{3n}$ transmitting the B data voltages, the number of signal lines $D_1, D_2, \ldots, D_n$ transmitting the data voltages from the data driver to demultiplexer 240 is n in correspondence to each one of R, G and B data lines.

In this way, data driver 230 sequentially outputs R, G and B data voltages to signal lines $D_1, D_2, \ldots, D_n$ under the control of the controller.

As shown in FIG. 5, demultiplexer 240 is supplied with the data voltages per R, G, and B from data driver 230, and then, it outputs the R, G, and B data voltages to respective data lines sequentially.

Demultiplexer 240 includes data voltage supplying switching elements $MR_1, MG_1, MB_1, MR_2, MG_2, MB_2, \ldots, MR_n, MG_n$, and $MB_n$ and precharge voltage supplying switching elements $PG_1, PB_1, PG_2, PB_2, \ldots, PG_n$, and $PB_n$ composed of PMOS transistors.

Data lines $Y_1$, $Y_2$, and $Y_3$ are connected to signal line $D_1$ in parallel with each other through the respective switching elements $MR_1$, $MG_1$, and $MB_1$, and data lines $Y_4$, $Y_5$, and $Y_6$ are connected to data line $D_2$ in parallel with each other through the respective switching elements $MR_2$, $MG_2$, and $MB_2$. In this way, data lines $Y_{3n-2}$, $Y_{3n-1}$, and $Y_{3n}$ are connected to signal line $D_n$ through the respective switching elements $MR_n$, $MG_n$, and $MB_n$. In addition, switching elements $PG_1, PB_1, PG_2, PB_2, \ldots, PG_n$, and $PB_n$ are connected between precharge voltage Vpre and data lines $Y_2, Y_3, Y_5, Y_6, \ldots, Y_{3n-1}$, and $Y_{3n}$.

Data voltage supplying switching elements $MR_1$ to $MR_n$ are connected to switching signal line 241, and transmit the R data voltages to data lines $Y_1, Y_4, \ldots, Y_{3n-2}$ and pixel circuits 212 in response to switching signal $H_R$ applied from the controller through signals lines 241. Data voltage supplying switching elements $MG_1$ to $MG_n$ are connected to switching signal line 243, and apply the G data voltages to data lines $Y_2, Y_5, \ldots, Y_{3n-1}$ and pixel circuits 212 in response to switching signal $H_G$. In addition, data voltage supplying switching elements $MB_1$ to $MB_n$ are connected to switching signal line 245, and apply the B data voltages to data lines $Y_3, Y_6, \ldots, Y_{3n}$ and pixel circuits 212 in response to switching signal $H_B$.

In addition, the precharge voltage supplying switching elements $PG_1$ to $PG_n$ are connected to signal line 242 and transmit precharge voltages Vpre via data lines $Y_2, Y_5, \ldots, Y_{3n-1}$ to pixel circuits 212 in response to switching signal $P_G$ applied through signal line 242 from the controller. Precharge voltage supplying switching elements $PB_1$ to $PB_n$ are connected to signal line 244 and transmit precharge voltages Vpre via data lines $Y_3, Y_6, \ldots, Y_{3n}$ to pixel circuits 212 in response to switching signal $P_B$.

Such precharge voltages Vpre must have a value equal to 'precharge voltage Vp—threshold voltage $V_{TH2}$' or a value that is further from the data voltages than that, compared with precharge voltage Vp applied to capacitor C1. In this way, transistor M2 is not turned on by the difference between voltage Vpre stored in the data line and voltage Vp stored in capacitor C1.

In the second embodiment of the present invention, although transistors M1, M2, M3, and M4 of pixel circuit 212; data voltage supplying switching elements $MR_1, MG_1, MB_1, MR_2, MG_2, MB_2, \ldots, MR_n, MG_n$, and $MB_n$; and precharge voltage supplying switching elements $PG_1, PB_1, PG_2, PB_2, \ldots, PG_n$, and $PB_n$ have been described using PMOS transistors, the present invention is not limited to these but may use NMOS transistors or a combination of PMOS transistors and NMOS transistors. Since alternative circuit configurations and driving signals in accordance with the teachings of the present invention will be apparent those skilled in the art, no further detailed description thereof will be included herein.

Next, referring to FIG. 6, the operation of the organic EL display panel according to the second embodiment of the present invention will be described.

Figure 6:
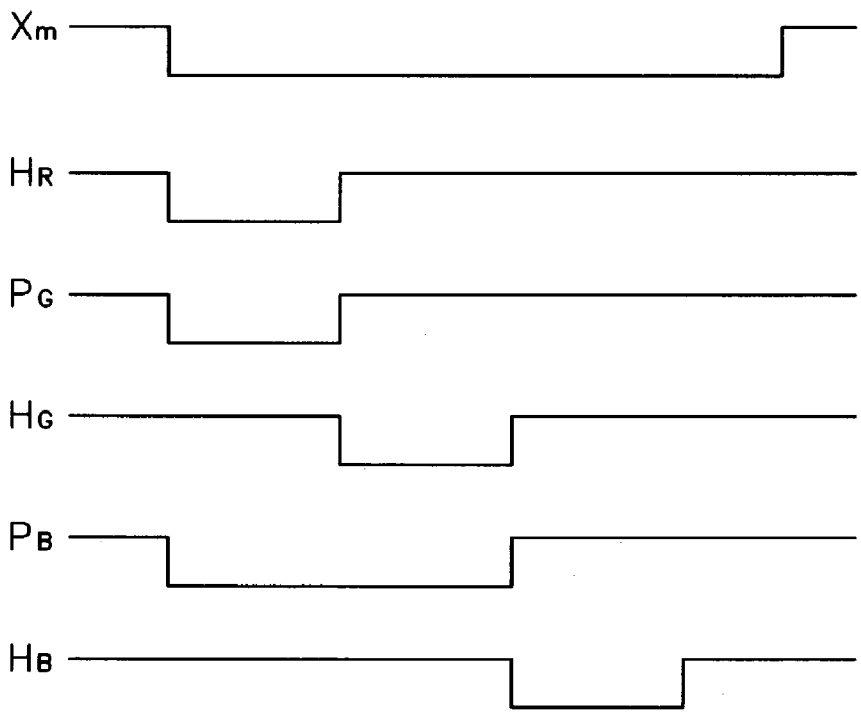
FIG. 6 shows a timing diagram of the organic EL display according to the second embodiment of the present invention.

As shown in FIG. 6, first, when R data voltages corresponding to pixel circuits 212 connected to scan line $X_m$ are applied from data driver 230, switching elements $MR_1$ to $MR_n$ and switching elements $PG_1$ to $PG_n$ and $PB_1$ to $PB_n$ are turned on by switching signals $H_R$, $P_G$, and $P_B$ and then the selection signal for selecting scan line $X_m$ is applied. In this way, pixel circuits 212 connected to scan line $X_m$ operate with R data voltages applied to data lines $Y_1, Y_4, \ldots, Y_{3n-2}$ and data lines $Y_2, Y_3, Y_5, Y_6, \ldots, Y_{3n-1}$ and $Y_3$are precharged to precharge voltages Vpre with the parasitic capacitors.

Next, when the G data voltages are applied from data driver 230, switching elements $MR_1$ to $MR_n$ and $PG_1$ to $PG_n$ are turned off, and switching elements $MG_1$ to $MG_n$ are turned on by switching signals $H_R$ and $P_G$ of high level, and switching signal $H_G$ of low level. In this way, pixel circuits 212 connected to scan line $X_m$ and data lines $Y_2, Y_5, \ldots, Y_{3n-1}$ operate with the G data voltages applied to those data lines and data lines $Y_3, Y_6, \ldots, Y_{3n}$ are still precharged to precharge voltages $V_{pre}$ with the parasitic capacitors.

Next, when the B data voltages are applied from data driver 230, switching elements $MG_1$ to $MG_n$ and switching elements $PB_1$ to $PB_n$ are turned off, and switching elements $MB_1$ to $MB_n$ are turned on by switching signals $H_G$ and $P_B$ of high level and switching signal $H_B$ of a low signal. In this way, pixel circuits 212 connected to scan line $X_m$ and data lines $Y_3, Y_6, \ldots, Y_{3n}$ operate with the B data voltages applied to those data lines.

As in the second embodiment of the present invention where the R, G, and B data voltages are applied sequentially for the time scan line $X_m$ is selected, the data lines $Y_2, Y_3, Y_5, Y_6, \ldots, Y_{3n-1}$, and $Y_{3n}$ are precharged to precharge voltages Vpre during the application of the R data voltages to data lines $Y_1, Y_4, \ldots, Y_{3n-2}$. Accordingly, since transistors M2 are not turned on by the differences between the precharge voltages stored in capacitors C1 and precharge voltages Vpre, capacitors C1 can be kept with precharge voltages Vp continuously.

Therefore, the problem previously described does not occur that transistors M2 are not turned on by applied data voltages due to changed voltages of capacitors C1.

Although, in the second embodiment of the present invention, it is described that the data voltages are outputted per R, G, and B sequentially and demultiplexer 240 works as 1:3 DEMUX, the present invention is not limited to this. N data lines may be formed as one group and the data voltages corresponding to respective groups may be outputted sequentially. In this way, the demultiplexer works as 1:N DEMUX to distribute the data voltages inputted to the respective groups to the corresponding the data lines out of the N data lines. Since alternative configurations and driving signals in accordance with the teachings of the present invention will be apparent those skilled in the art, no further detailed description thereof will be included herein.

Next, the case where the data driver is configured by using a shift register will be described.

First, referring to FIG. 7 and FIG. 8, an organic EL display and a driving method thereof will be described.

Figure 7:
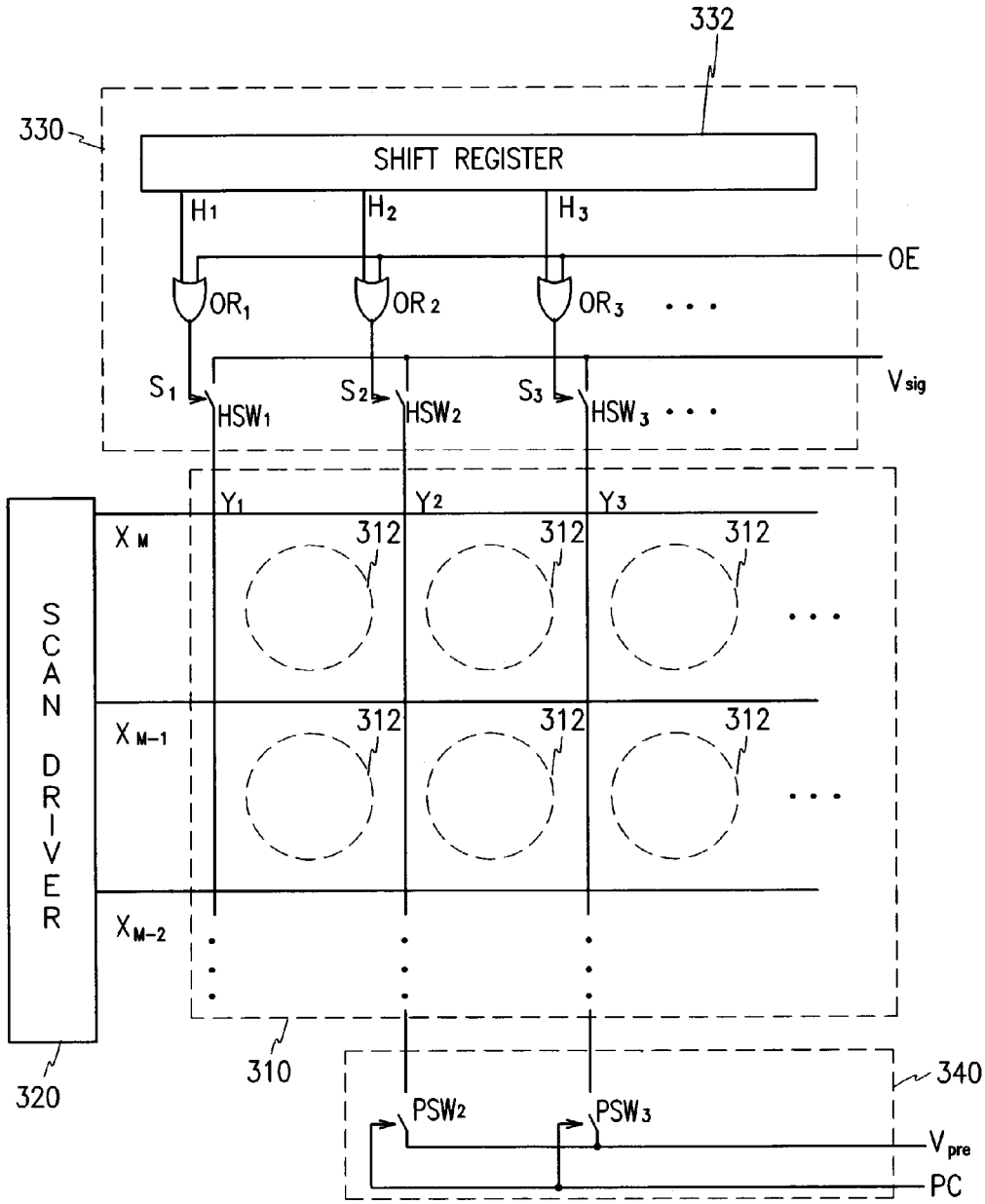
FIG. 7 and FIG. 9 show organic EL displays according to a third and a fourth embodiments of the present invention, respectively.
Figure 8:
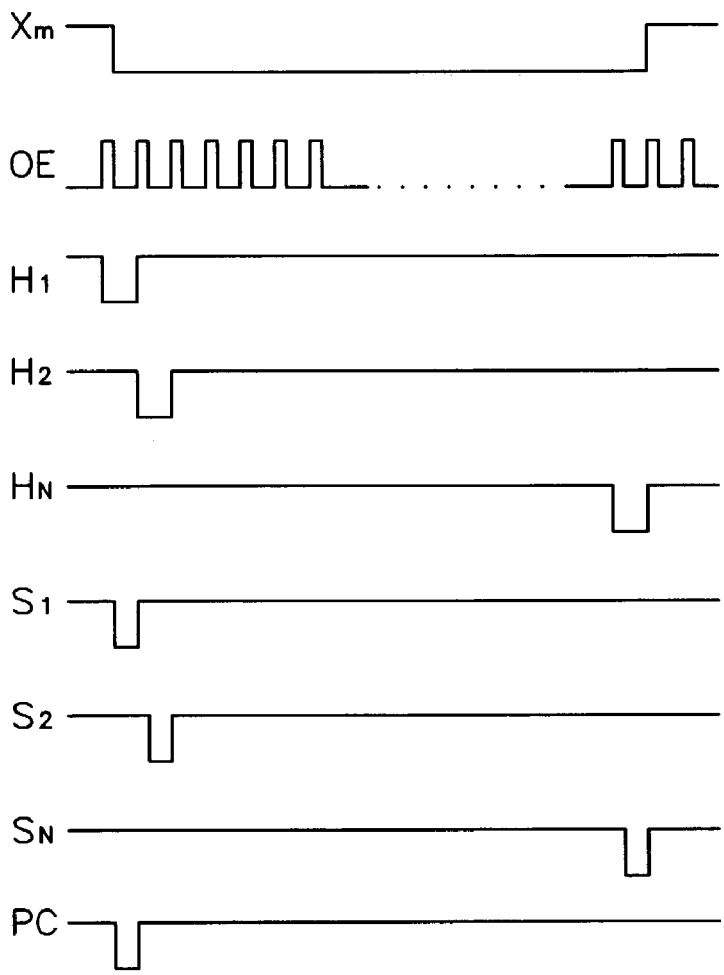
FIG. 8 and FIG. 10 show timing diagrams of the organic EL displays according to the third and the fourth embodiments of the present invention.

FIG. 7 shows an organic EL display according to a third embodiment of the present invention, and FIG. 8 shows timing diagrams of the organic EL display according to the third embodiment of the present invention.

As shown in FIG. 7, the organic EL display according to the third embodiment of the present invention includes organic EL display panel 310, scan driver 320, data driver 330, and precharge means 340.

Organic EL display panel 310 includes a plurality of data lines $Y_1$ to $Y_n$ transmitting the data voltages representing image signals, a plurality of scan lines $X_1$ to $X_M$ transmitting selection signals, and a plurality of pixel circuits 312. Pixel circuits 312 include pixel circuits 112 according to the first embodiment and all the pixel circuits capable of being modified in the first embodiment of the present invention.

Scan driver 320 applies the selection signals to scan lines $X_1$ to $X_M$ to control on/off of thin film transistors M3 of pixel circuits 312.

Data driver 330 includes shift register 332, a plurality of OR gates $OR_1$ to $OR_N$, and data voltage switching elements $HSW_1$ to $HSW_N$ made of PMOS transistors.

Shift register 332 outputs control signals $H_1$ to $H_N$ for controlling on/off of switching elements $HSW_1$ to $HSW_N$, and these signals $H_1$ to $H_N$ are inputted to respective OR gates $OR_1$, to $OR_N$ together with an OE signal from a controller (not shown). The OE signal is a control signal for selecting the data lines after the data of image signals Vsig is changed, and the respective outputs of OR gates $OR_1$ to $OR_N$ become switching signals for turning on/off switching elements $HSW_1$ to $HSW_N$.

The image signals Vsig are sequentially sampled by switching signals $S_1$ to $S_N$ of shift register 332 to be applied to respective data lines $Y_1$ to $Y_N$. In detail, one ends of switching elements $HSW_1$ to $HSW_N$ are connected to one ends of data lines $Y_1$ to $Y_N$, and the other ends of switching elements $HSW_1$ to $HSW_N$ are connected to image signal lines 334 transmitting image signals $V_{sig}$. Switching elements $HSW_1$ to $HSW_N$ sequentially apply the image signals to respective data lines $Y_1$ to $Y_N$, responding to switching signals $S_1$ to $S_N$, respectively.

Precharge means 340 are connected to the other ends of data lines $Y_2$ to $Y_N$ and include switching elements $PSW_2$ to $PSW_N$ composed of PMOS transistors for precharging. Switching elements $PSW_2$ to $PSW_N$ apply precharge voltage Vpre to data lines $Y_2$ to $Y_N$ at the same time in response to precharge control signal PC from the controller. Precharge voltage Vpre has a value equal to 'precharge voltage Vp—threshold voltage $V_{TH2}$' or a value further from image signals Vsig than that, compared with precharge voltage Vp applied to capacitors C1.

In the third embodiment of the present invention, although switching elements $HSW_1$ to $HSW_N$ and $PSW_1$ to $PSW_N$ are respectively provided at both ends of data lines $Y_1$ to $Y_N$, they may also be provided at either end of data lines $Y_1$ to $Y_N$.

In addition, although transistors M1, M2, M3, and M4, switching elements $HSW_1$ to $HSW_N$, and switching elements $PSW_2$ to $PSW_N$ have been described to be composed of PMOS transistors, the present invention is not limited to this but they may be composed of NMOS transistors or both of PMOS and NMOS transistors. Since alternative circuit configurations and driving signals in accordance with the teachings of the present invention will be apparent those skilled in the art, no further detailed description thereof will be included herein.

Referring to FIG. 8, an operation of the organic EL display according to the third embodiment of the present invention will be described in the following.

As shown in FIG. 8, first, switching element $HSW_1$ and switching elements $PSW_2$ to $PSW_N$ are turned on by switching signal $S_1$ and control signals PC of low level, and then the selection signal for selecting scan line $X_m$ are applied. Then, organic EL device OLED of pixel circuit 312 connected to scan line $X_m$ and data line $Y_1$ is driven with the data voltage that is sampled from image signal Vsig by switching element $HSW_1$, and data lines $Y_2$ to $Y_N$ are precharged to precharge voltages Vpre by the parasitic capacitors.

Next, the control signals are inverted to turn off switching elements $PSW_2$ to $PSW_N$, and thereby, data lines $Y_2$ to $Y_N$ are floated to be kept with precharge voltage Vpre until the data voltages are applied thereto. Thereafter, shift register 332 shifts and outputs the selection signal to turn on switching elements $HSW_2$ to $HSW_N$ sequentially to apply image signal Vsig to data lines $Y_2$ to $Y_N$, and thereby, driving organic EL device OLED.

In this way, since data lines $Y_2$ to $Y_N$ are kept with precharge voltages Vpre until the data voltages are applied, transistors M2 are not turned on by differences between precharge voltages Vp stored in capacitors C1 and precharge voltages Vpre at the time of selecting scan line $X_m$. Accordingly, capacitors C1 are kept with precharge voltages Vp continuously. Therefore, the case where transistors M2 are not turned on at the time the data voltages are applied due to the change of the voltages of capacitors C1, as described before, does not occur.

However, in case of driving switching elements $PSW_2$ to $PSW_N$ at the same time with a single signal as in the third embodiment of the present invention, as the size of the panel and resolution thereof become larger, resistances of the signal lines and gate capacitances of the thin film transistors are increased accordingly, thereby, increasing RC delays.

Since rising time and falling time of precharge control signal PC becomes larger due to such RC delay, the time difference between the leading edge of switching signal $H_1$ and the leading edge of the switching signal $H_2$ must become larger. Thus, since pulse widths of switching signals $H_1$ to $H_N$ must be increased, the speed of clock must be decreased, and in the end, this limits the frequency of data driver 330.

To solve such problem, switching elements for precharging may be driven respectively, and in the following, such an embodiment will be described with reference to FIGS. 9 and 10.

Figure 9:
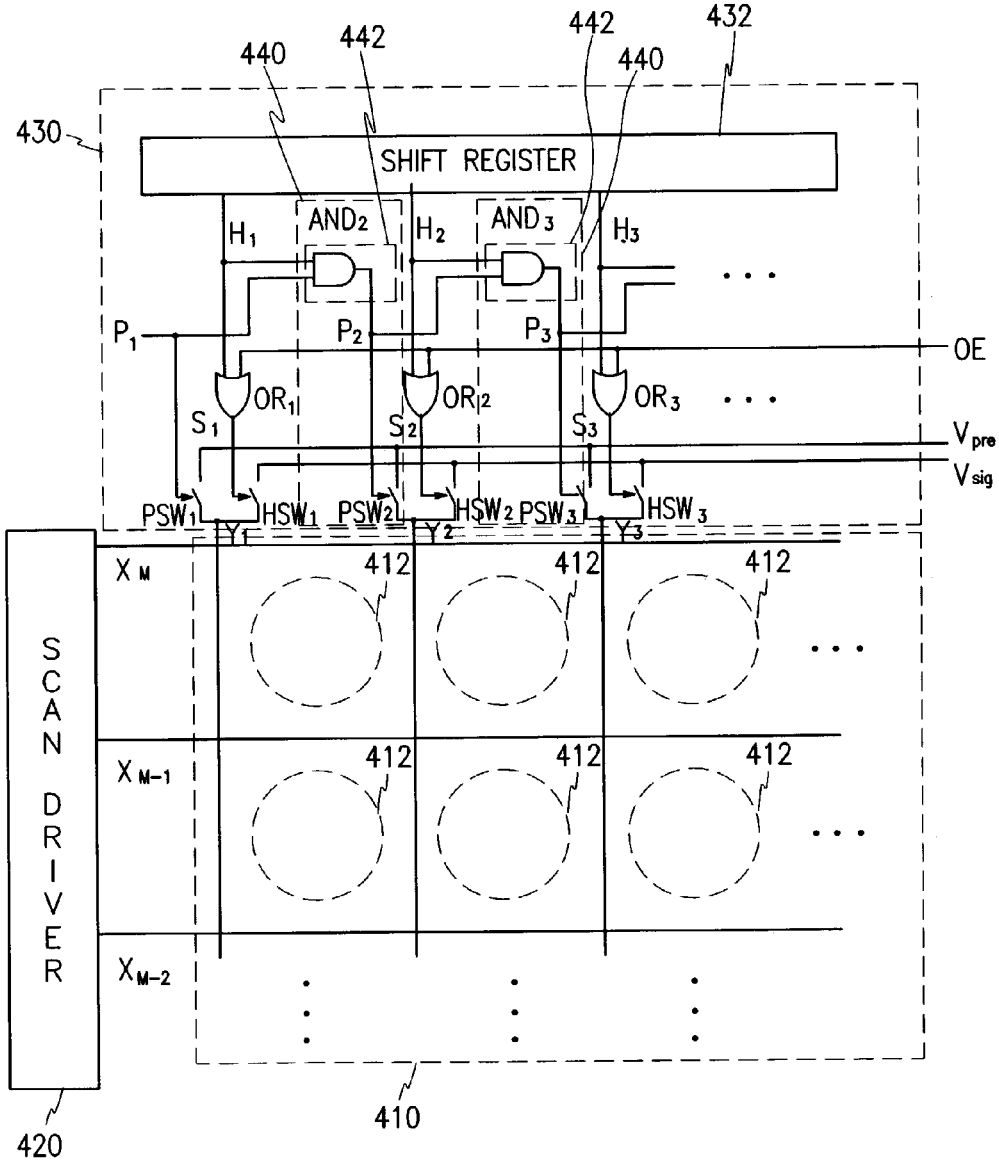
Figure 10:
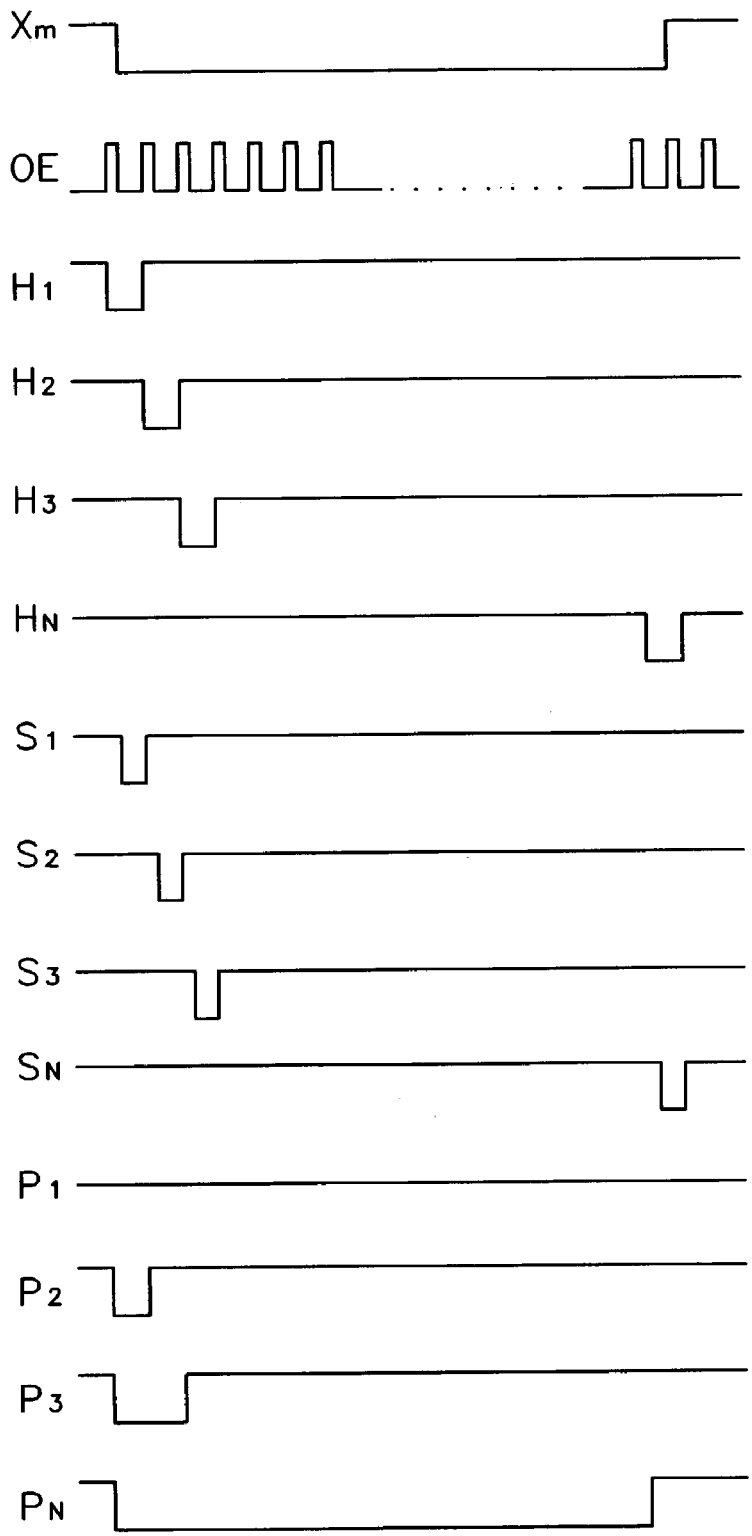

FIG. 9 shows an organic EL display according to a fourth embodiment of the present invention, and FIG. 10 shows a timing diagram of the organic EL display according to the fourth embodiment of the present invention.

As shown in FIG. 9, the organic EL display according to the fourth embodiment of the present invention includes organic EL display panel 410, scan driver 420, data driver 430, and precharge means 440.

Organic EL display panel 410 and scan driver 420 of the fourth embodiment are the same as organic EL display panel 310 and scan driver 320 of the third embodiment, and pixel circuits 412 of organic EL display panel 410 include the pixel circuits according to the first embodiment and all the pixel circuits capable of being modified in the first embodiment of the present invention.

Data driver 430 includes shift register 432, switching elements for data voltage $HSW_1$ to $HSW_N$, and OR gate $OR_1$ to $OR_N$.

Shift register outputs control signals $H_1$ to $H_N$ for controlling switching elements $HSW_1$, to $HSW_N$ sequentially, and these control signals are inputted to respective OR gates $OR_1$ to $OR_N$ together with an OE signal from a controller (not shown). Respective outputs of OR gates $OR_1$ to $OR_N$ become switching signals $S_1$ to $S_N$ for turning on/off switching elements $HSW_1$ to $HSW_N$.

Image signals Vsig are sampled sequentially by the switching signals of shift register 432 to be applied to respective data lines $Y_1$ to $Y_N$. In detail, one ends of data lines $Y_1$ to $Y_N$ are respectively connected to one ends of switching elements $HSW_1$ to $HSW_N$, and the other ends of switching elements $HSW_1$, to $HSW_N$ are respectively connected to image signal line 434 for transmitting image signals Vsig. Switching elements $HSW_1$ to $HSW_N$ sequentially transmit the image signals to respective data lines $Y_1$ to $Y_N$ in response to switching signals $S_1$ to $S_N$.

Precharge means 440 include switching elements for precharging $PSW_2$ to $PSW_N$ and a plurality of precharge control signal generators 442.

Precharge control signal generators 442 respectively receive control signals $H_1$ to $H_{N-1}$ from shift register 432 and previous precharge control signals $P_1$ to $P_{N-1}$ to generate precharge control signals $P_2$ to $P_N$. Precharge control signal $P_1$ is a signal always high. Precharge control signal generators 442 are composed of AND gates in the fourth embodiment of the present invention.

Switching elements $PSW_2$ to $PSW_N$ transmit precharge voltages Vpre to data lines $Y_2$ to $Y_N$ in response to 'precharge control signals $P_2$ to $P_N$. Such precharge control signal Vpre is equal to precharge voltage Vp—threshold voltage $V_{TH2}$' or further from voltage Vsig than that, compared with the precharge voltage applied to capacitor C1.

Now, the operation of the organic EL display according to the fourth embodiment of the present invention will be described with reference to FIG. 10.

As shown in FIG. 10, precharge control signals $P_2$ to $P_N$ become low level by control signal $H_1$ of low level, control signal $H_2$ to $H_N$ of high level, and control signal $P_1$ of high level. Switching elements $HSW_1$, and switching elements $PSW_2$ to $PSW_N$ are turned on by these signals and the selection signal for selecting scan line $X_m$ is applied. Then, organic EL device OLED of pixel circuit 412 connected to scan line $X_m$ and data line $Y_1$ are driven by the data voltage sampled by switching element $HSW_1$, and data lines $Y_2$ to $Y_N$ are precharged to precharge voltages Vpre by the parasitic capacitors.

Next, when control signal $H_1$ becomes high level and control signal $H_2$ becomes low level by shift register 432, control signal $P_2$ becomes high level, and control signals $P_3$ to $P_N$ are kept with low level continuously. Switching element $PSW_2$ is turned off, and switching element $HSW_2$ is turned on by such signals to transmit the data voltage to data line $Y_2$, and switching elements $PSW_3$ to $PSW_N$ are turned on continuously to transmit the precharge voltages to data lines $Y_3$ to $Y_N$.

As above, switching elements $HSW_2$ to $HSW_N$ are sequentially turned on, and switching elements $PSW_2$ to $PSW_N$ are sequentially turned off, thereby, applying the data voltages to data lines $Y_2$ to $Y_N$, and the data lines are charged to precharge voltage Vpre until the data voltages are applied to them.

In this way, since data lines $Y_2$ to $Y_N$ are kept with precharge voltages Vpre until the data voltages sampled from image signal Vsig are applied thereto, transistor M2 is not turned on by difference between precharge voltage Vp stored in capacitor C1 at the time scan line $X_{m-1}$ is selected and precharge voltage Vpre, and thus, capacitor C1 can be kept with precharge voltage Vp.

Therefore, the case where transistors M2 are not turned on at the time the data voltages are applied due to the change of the voltages of capacitors C1, as described before, does not occur.

Figure 11:
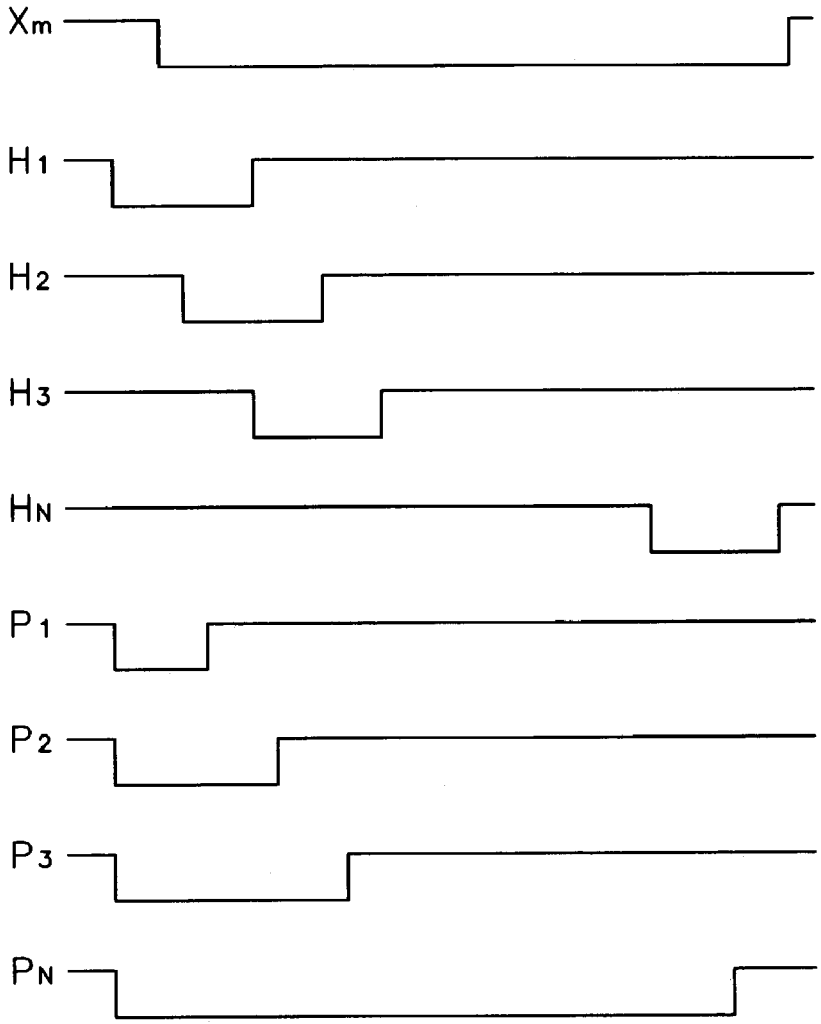
FIG. 11 shows a timing diagram of an organic EL display according to a fifth and a sixth embodiments of the present invention.

Meanwhile, as shown in FIG. 11, when shift register 432 which outputs partially overlapped control signals $H_1$ to $H_N$ is used, the problem described above may occur. That is, data line $Y_2$ is connected to the image signal line that transmits image signal Vsig, by control signal $H_2$, while the data are written to data line $Y_1$. In this case, when image signal Vsig becomes a value corresponding to data line $Y_2$ and data line $Y_2$ has to be written on, the data written to data line $Y_2$ for the time data line $Y_1$ is written on may cause a problem that transistor M2 is not turned on as described above.

Embodiments of the case that shift register 432 which outputs partially overlapped control signals $H_1$ to $H_N$ is used will be described in detail with reference to FIGS. 11 to 13.

FIG. 11 is a timing diagram of organic EL displays according to a fifth and a sixth embodiment of the present invention. FIGS. 12 and 13 are diagrams to illustrate precharge control signal generators in the organic EL displays according to the fifth and the sixth embodiments of the present invention.

Figure 12:
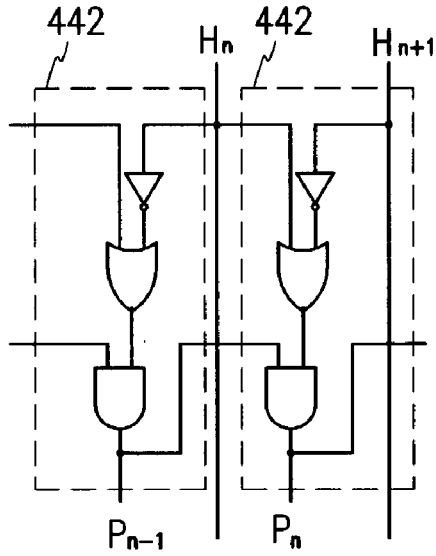
FIG. 12 shows a precharge control signal generator in the organic EL display according to the fifth embodiment of the present invention.

Accordingly, when precharge control signal generators 442 as shown in FIG. 12 generate precharge control signals $P_1$ to $P_N$, precharge control signals are generated as shown in FIG. 11 in the fifth embodiment of the present invention. Now, precharge control signal generator 442 for generating precharge control signal $P_n$ applied to data line $Y_n$ will be described.

Precharge control signal generator 442 for generating precharge control signal $P_n$ includes an inverter, an OR gate, and an AND gate. The OR gate receives a signal that the inverter outputs in response to control signal $H_{n+1}$ corresponding to the next data line $Y_{n+1}$ and a control signal corresponding to the present data line $Y_n$. Output of the OR gate and previous precharge control signal $P_{n-1}$ are inputted together to the AND gate to generate precharge control signal $P_n$.

Precharge control signals $P_1$ to $P_N$ generated as above are as shown in FIG. 11. For example, while the corresponding data voltage is applied to data line $Y_1$ by control signal $H_1$, a time interval that switching element $HSW_2$ is turned on by control signal $H_2$ of low level is generated. In this case, until image signal Vsig becomes a value corresponding to data line $Y_2$, switching element $PSW_2$ may be turned on by precharge control signal $P_2$ according to the fifth embodiment to transmit precharge voltage Vpre.

As above, in case precharge voltage Vpre is applied to data line $Y_2$ in the interval that switching elements $HSW_2$ and $PSW_2$ are turned on, precharge voltage Vpre has to be set so that the voltage applied to data line $Y_2$ and determined by image signal Vsig and precharge voltage Vpre is equal to 'precharge voltage Vp—threshold voltage $V_{TH2}$' or further from image signal $V_{sig}$ than that.

According to such fifth embodiment, the driving voltages of switching elements $PSW_2$ and $HSW_2$ may increase as the difference between precharge voltage Vpre and image signal Vsig increases. When the driving voltages are increased, there is a problem that power consumption is also increased.

Therefore, a shift register whose outputs do not overlap each other is configured in a sixth embodiment by adjusting outputs of the shift register in the fifth embodiment.

Figure 13:
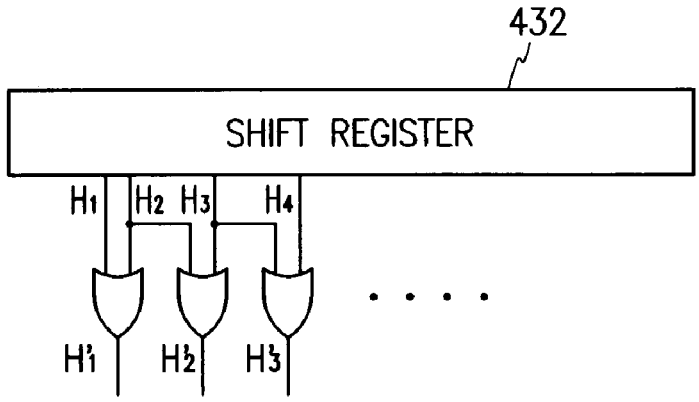
FIG. 13 shows an output part of a shift register in the organic EL display according to the sixth embodiment of the present invention.

As shown in FIG. 13, in case switching elements $HSW_1$ to $HSW_N$ are PMOS transistors, the shift register whose outputs do not overlap may be provided by an OR operation of the two adjacent outputs of shift register 432 with OR gates.

For example, the result of performing an OR-operation of outputs $H_1$ and $H_2$ of shift register 432 is made to be new output $H_1'$. That is, when both of two outputs $H_1$ and $H_2$ are low levels, output $H_1'$ of the OR gate becomes low level, and also, when both of outputs $H_2$ and $H_3$ are low levels, output $H_2'$ becomes low level, and thereby, it is possible to form a shift register without overlapping the outputs.

Although the switching elements have been described with using PMOS transistors in the first to the sixth embodiments, the present invention is not limited to this but may use NMOS transistors, CMOS transistors, or a combination thereof. Since alternative circuit configurations and driving signals in accordance with the teachings of the present invention will be apparent those skilled in the art, no further detailed description thereof will be included herein.

In addition, as shown in FIG. 3B, also in the second to the sixth embodiments of the present invention, a separate reset signal is applied to the gate of transistor M4 to drive it to charge capacitor C1 of pixel circuit 112 with precharge voltage Vp.

According to the present invention as described above, by applying precharge voltages Vpre to the data lines before the data voltages are applied thereto, it is possible to prevent the charge redistribution of capacitors C1 that is generated due to turning on of the switching elements with precharge voltage Vp charged in capacitors C1 of the pixel circuits when the previous scan line is selected and the previous data voltages stored in the parasitic capacitors of the data lines. Therefore, it is possible to solve the problem of poor images caused by the charge redistribution of capacitors C1.

In addition, although the pixel circuits with four transistors have been described as an example in the embodiments of the present invention, the present invention is not limited to this but is applicable to all of the pixel circuits that precharge voltages Vp are applied to. Furthermore, although the organic EL display has been described as an example in the embodiments of the present invention, the present invention is not limited to this but is applicable to all of the displays applying precharge voltages Vp to capacitors C1 provided in the pixel circuits. In other words, in case the pixel circuits of the displays include transistors driven by the signals applied through the gate lines and the data lines and transistors for applying precharge voltages Vp, it is possible to improve the poor images by applying precharge voltages Vpre to the data lines, as described in the embodiments of the present invention.

Although various embodiments of the present invention have been described in detail hereinabove, it should be clearly understood that many variations and/or modifications based on the basic concepts defined in the appended claims still fall within the spirit and scope of the present invention.

What is claimed is:

1. An organic electroluminescence display comprising:

a plurality of data lines transmitting data voltages;

a plurality of scan lines transmitting selection signals;

a plurality of pixel circuits provided in pixel areas defined by two adjacent data lines and two adjacent scan lines, and having first switching elements responding to the selection signals applied to the scan lines to transmit the data voltages applied to the data lines, first thin film transistors supplying currents to organic electroluminescence devices in correspondence to the data voltages inputted to gates thereof through the first switching elements, capacitors for maintaining the data voltages during a certain time, and second switching elements applying first precharge voltages to the capacitors in response to control signals while the selection signals are applied to previous scan lines;

a data driver dividing the data lines into a plurality of groups to selectively apply the data voltages to the respective groups by group unit; and a demultiplexer applying the data voltages selectively applied from the data driver to corresponding data lines and applying second precharge voltages based on the first precharge voltages to the data lines of at least one group out of the groups before the selection signals for selecting scan lines are applied to the scan lines connected to the pixel circuits.

2. The organic electroluminescence display of claim 1, wherein the demultiplexer includes:

a plurality of third switching elements, each connected to the data line, and turned on when data voltage corresponding to the connected data line is applied; and a plurality of fourth switching elements, each connected between signal for the second precharge voltage and data line of at least one group, and turned on before the selection signal is applied to the scan line connected to the pixel circuit and turned off when the corresponding data voltage is applied to the connected data line.

3. The organic electroluminescence display of claim 2, wherein the data driver divides the data lines into three groups to which the data voltages corresponding to first to third colors are applied, thereby outputs the data voltages corresponding to the first to the third colors sequentially, and wherein the plurality of fourth switching elements are connected to the data lines corresponding to at least one color of the first to the third colors.

4. The organic electroluminescence display of claim 1, wherein the pixel circuits include second thin film transistors of which the gates are connected to the gates of the first thin film transistors and that are diode-connected between the first switching elements and the second switching elements, and wherein the second precharge voltage has a value equal to 'the first precharge voltage—threshold voltage of the second thin film transistor' or a value further from the data voltage.

5. The organic electroluminescence display of claim 1, wherein the control signals are selection signals applied to previous scan lines.

6. The organic electroluminescence display of claim 1, wherein the control signals are separate reset signals.

7. The organic electroluminescence display of claim 1, wherein the second precharge voltages have constant values.

8. An organic electroluminescence display comprising:

a plurality of data lines transmitting data voltages;

a plurality of scan lines transmitting selection signals;

a plurality of pixel circuits provided in pixel areas defined by two adjacent data lines and two adjacent scan lines, and having first switching elements responding to the selection signals applied to the scan lines to transmit the data voltages applied to the data lines, first thin film transistors supplying currents to organic electroluminescence devices in correspondence to the data voltages inputted to gates thereof through the first switching elements, capacitors for maintaining the data voltages during a certain time, and second switching elements applying first precharge voltages to the capacitors in response to control signals while the selection signals are applied to previous scan lines;

a data driver applying the data voltages to the data lines sequentially; and a precharge means applying second precharge voltages to the data lines before the selection signals for selecting scan lines are applied to the scan lines and stopping the application of the second precharge voltages simultaneously when the data voltage is applied to any one of the data lines to which the precharge voltages are applied.

9. The organic electroluminescence display of claim 8, wherein the data driver includes:

a plurality of third switching elements, each connected between at least one signal line transmitting image signals representing the data voltages and the data lines, to perform switching operations when the image signals have values corresponding to the data lines; and a shift register sequentially outputting a plurality of switching signals for driving the third switching elements, respectively, wherein the precharge means includes a plurality of fourth switching elements connected between a second signal line for transmitting the second precharge voltages and the data lines, and turned on simultaneously before the selection signals for selecting scan lines are applied to the scan lines connected to the pixel circuits and turned off simultaneously when the data voltage is applied to any one of the connected data lines.

10. The organic electroluminescence display of claim 9, wherein the fourth switching elements are connected to at least second to last data lines of the data lines, respectively.

11. The organic electroluminescence display of claim 9, wherein, when both of two adjacent outputs of the shift register have levels for driving the third switching elements, the switching signals are changed into levels for driving the third switching elements.

12. The organic electroluminescence display of claim 8, wherein the pixel circuits include second thin film transistors of which gates are connected to the gates of the first thin film transistors and that are diode-connected between the first switching elements and the second switching elements, and wherein the second precharge voltage has a value equal to 'the first precharge voltage—threshold voltage of the second thin film transistor' or a value further from the data voltage.

13. The organic electroluminescence display of claim 8, wherein the control signals are selection signals applied to previous scan lines.

14. The organic electroluminescence display of claim 8, wherein the control signals are separate reset signals.

15. The organic electroluminescence display of claim 8, wherein the precharge voltages have constant values.

16. An organic electroluminescence display comprising:

a plurality of data lines transmitting data voltages;

a plurality of scan lines transmitting selection signals;

a plurality of pixel circuits provided in pixel areas defined by two adjacent data lines and two adjacent scan lines, and having first switching elements responding to the selection signals applied to the scan lines to transmit the data voltages applied to the data lines, first thin film transistors supplying currents to organic electroluminescence devices in correspondence to the data voltages inputted to gates thereof through the first switching elements, capacitors for maintaining the data voltages during a certain time, and second switching elements applying first precharge voltages to the capacitors in response to control signals while the selection signals are applied to previous scan lines;

a data driver applying the data voltages to the data lines sequentially; and a precharge means applying second precharge voltages based on the first precharge voltages to the data lines before the selection signals for selecting scan lines are applied to the scan lines connected to the pixel circuits, and sequentially stopping the application of the second precharge voltages to the respective data lines before the data voltages are applied to the respective data lines.

17. The organic electroluminescence display of claim 16, wherein the data driver includes a plurality of third switching elements connected between at least one first signal line for transmitting image signals representing data voltages and the data lines, to perform switching operations when the image signals have values corresponding to the data lines; and a shift register sequentially outputting a plurality of switching signals for driving the third switching elements, respectively, wherein, the precharge means includes a plurality of fourth switching elements connected between a second signal line for transmitting the precharge voltages and the data lines; and a plurality of precharge control signal generators receiving precharge control signals for driving the fourth switching elements connected to the previous data lines and the switching signals for driving the third switching elements connected to the previous data lines, and generating precharge control signals for driving the fourth switching elements connected to the present data lines.

18. The organic electroluminescence display of claim 17, wherein the precharge control signal generators are composed of AND gates receiving the switching signals for driving the third switching elements connected to the previous data lines and the precharge control signals for driving the fourth switching elements connected to the previous data lines.

19. The organic electroluminescence display of claim 17, wherein the precharge control signal generators generate precharge control signals for turning off the fourth switching elements connected to the present data lines when switching signals for turning on the third switching elements connected to next data lines are applied.

20. The organic electroluminescence display of claim 19, wherein the precharge control signal generators include OR gates receiving inverted values of switching signals for driving the third switching elements connected to next data lines and switching signals for driving the third switching elements connected to the present data lines as inputs; and AND gates receiving outputs of the OR gates and previous precharge control signals as inputs, wherein the outputs of the AND gates become precharge control signals.

21. The organic electroluminescence display of claim 17, wherein, when both of the two adjacent outputs of the shift register have levels for driving the third switching elements, the switching signals are changed into devels for driving the third switching elements.

22. The organic electroluminescence display of claim 17, wherein the pixel circuits include second thin film transistors of which gates are connected to the gates of the first thin film transistors and that are diode-connected between the first switching elements and the second switching elements, and wherein the second precharge voltage has a value equal to 'the first precharge voltage—threshold voltage of the second thin film transistor' or a value further from the data voltage.

23. The organic electroluminescence display of claim 17, wherein the control signals are selection signals applied to previous scan lines.

24. The organic electroluminescence display of claim 17, wherein the control signals are separate reset signals.

25. The organic electroluminescence display of claim 17, wherein the precharge voltages have constant values.

26. A method of driving an organic electroluminescence display comprising a plurality of data lines transmitting data voltages; a plurality of scan lines transmitting selection signals; and a plurality of pixel circuits provided in pixel areas defined by two adjacent data lines and two adjacent scan lines, and having first thin film transistors supplying currents to organic electroluminescence devices and capacitors for maintaining the data voltages during a certain time, the method comprising:

(a) precharging the capacitor of the pixel circuit connected to i-th scan line with the first precharge voltage while selection signal is applied to (i−1)th scan line;

(b) applying second precharge voltages based on the first precharge voltages to the data lines before selection signal is applied to the i-th scan line; and (c) stopping application of the second precharge voltage when the data voltages are applied to the data lines to which the second precharge voltages have been applied, applying corresponding data voltages to the respective groups of the data lines which consist of at least one data line.

27. The method of claim 26, wherein, in the step (b), the precharge voltages are applied to the data lines at the same time.

28. The method of claim 26, wherein, in the step (b), the second precharge voltages are applied to the data lines sequentially.

29. The method of claim 26, wherein, in the step (c), application of the second precharge voltages is stopped for all data lines before data voltages are applied to any one of groups to which the second precharge voltages have been applied.

30. The method of claim 26, wherein, in the step (C), before data voltages are sequentially applied to groups to which the second precharge voltages have been applied, applications of the second precharge voltages to the respective groups are stopped sequentially.

31. The method of claim 26, wherein the second precharge voltages have constant values.

32. The method of claim 26, wherein each of the pixel circuits includes a switching element connected between the capacitor and the first precharge voltage, wherein, in the step (a), the switching elements are driven by selection signal applied to (i−1)-th scan line to charge the capacitors with the first precharge voltages.

33. The method of claim 26, wherein each of the pixel circuits includes a switching element connected between the capacitor and the first precharge voltage, wherein, in the step (a), the capacitors are charged with the first precharge voltages by separate reset signals.

34. A display comprising:

a plurality of data lines transmitting data voltages representing the image signals;

a plurality of scan lines transmitting selection signals;

a plurality of pixel circuits provided in pixel areas defined by two adjacent data lines and two adjacent scan lines, and having first switching elements responding to the selection signals applied to the scan lines to transmit the data voltages applied to the data lines, capacitors for maintaining the data voltages during a certain time, and second switching elements applying first precharge voltages to the capacitors in response to control signals while the selection signals are applied to previous scan lines;

a data driver dividing the data lines into a plurality of groups to selectively apply the corresponding data voltages to the respective groups; and a precharge means applying second precharge voltages based on the first precharge voltages to the data lines of at least one group before the selection signals for selecting scan lines are applied to the scan lines connected to the pixel circuits, and stopping the application of the second precharge voltages when the corresponding data voltages are applied to the groups.

35. The display of claim 34, wherein the second precharge voltage has a value equal to 'the first precharge voltage—threshold voltage of a thin film transistor' or a value further from the data voltage.

36. The display of claim 34, wherein the precharge voltages have constant values.

37. The display of claim 34, wherein the control signals are selection signals applied to previous scan lines.

38. The display of claim 34, wherein the control signals are separate reset signals.

* * * * *